US005678343A

United States Patent [19]

Menges et al.

[11] Patent Number: 5,678,343

[45] Date of Patent: Oct. 21, 1997

[54] SAFETY LOCK FOR SECURING A REPLACEABLE BARREL TO THE HOUSING OF AN AUTOMATIC WEAPON

[75] Inventors: Horst Menges, Ratingen; Lothar Post, Fassberg, both of Germany

[73] Assignee: Rheinmetall Industrie GmbH, Ratingen, Germany

[21] Appl. No.: 629,482

[22] Filed: Apr. 10, 1996

[30] Foreign Application Priority Data

Apr. 11, 1995 [DE] Germany ..... 195 13 594.6

[51] Int. Cl.[6] ..... F41A 7/08

[52] U.S. Cl. ..... 42/75.02; 42/16; 42/70.01

[58] Field of Search ..... 42/75.02, 16, 70.01; 89/20.4, 37.11

[56] References Cited

U.S. PATENT DOCUMENTS

| | | | |
|---|---|---|---|
| 2,014,184 | 9/1935 | Linder | 42/75.02 |
| 4,471,551 | 9/1984 | Mattarelli | 42/70.01 |
| 4,648,191 | 3/1987 | Goff et al. | 42/75.02 |

FOREIGN PATENT DOCUMENTS

| | | | |
|---|---|---|---|
| 94083 | 6/1969 | France | 42/75.02 |
| 1453925 | 7/1969 | Germany | 42/75.02 |
| 506632 | 6/1939 | United Kingdom | 42/75.02 |

*Primary Examiner*—Stephen M. Johnson
*Attorney, Agent, or Firm*—Spencer & Frank

[57] ABSTRACT

An automatic weapon includes a housing; a bolt movably received in the housing; a weapon barrel replaceably received in the housing and having a recess; and a locking member movably supported in the housing to assume locking and releasing positions. In the locking position the locking member projects into the recess for locking the weapon barrel to the housing and in the releasing position the locking member is withdrawn from the recess. There are further provided a spring for urging the locking member into the releasing position; a shaft rotatably supported in the housing and a cam secured to the shaft for rotating therewith as a unit and for contacting the locking member. The cam has a first angular position in which it holds the locking member in the locking position and a second angular position in which the spring holds the locking member in the releasing position. An external weapon-operating device moves the bolt into an unsecured position in which an accidental firing of a cartridge in the weapon barrel is possible and a secured position in which an accidental firing of a cartridge in the weapon barrel is not possible. The weapon-operating device moves the cam from the first into the second angular position when moving the bolt into the secured position.

4 Claims, 3 Drawing Sheets

SAFETY LOCK FOR SECURING A REPLACEABLE BARREL TO THE HOUSING OF AN AUTOMATIC WEAPON

BACKGROUND OF THE INVENTION

This invention relates to an automatic weapon having a barrel, a bolt (breachblock) and a weapon housing to which the barrel is replaceably secured. For safety reasons the weapon barrel may be removed or installed only if the bolt is in a position in which an unintentional firing of a cartridge—placed intentionally or unintentionally in the weapon chamber—is not possible. The weapon barrel is provided with a recess which extends from the outer barrel surface inwardly and into which—for locking the weapon barrel—a locking component projects which is radially shiftable against the force of a spring.

A weapon of the above-outlined type is disclosed, for example, in German Patent No. 2,834,332. In the known weapon the barrel is also locked on the bolt side in order to prevent an ignition of the propellant when the weapon barrel is not properly locked to the weapon housing or in case of other irregularities, such as a damaged cartridge or damaged bolt portions. For this purpose, the weapon barrel has a recess in its outer surface into which extends a spring-biased locking part supported in the weapon housing. The locking part is secured by the cartridge magazine of the weapon. Further, the prior art weapon provides that, for installation or removal, the weapon barrel can be rotated only if the weapon bolt is open. The weapon cannot be loaded as long as the weapon barrel is not inserted correctly.

It is a principal disadvantage of the prior art weapon outlined above that the installation and removal of the weapon barrel requires a relatively long period of time because, among others, first the magazine has to be removed and the bolt opened.

SUMMARY OF THE INVENTION

It is an object of the invention to provide an improved automatic weapon of the above-outlined type in which a more rapid and more secure barrel replacement may be effected, regardless of whether the cartridges are loaded into the chamber from a magazine or from a cartridge belt.

This object and others to become apparent as the specification progresses, are accomplished by the invention, according to which, briefly stated, the automatic weapon includes a housing; a bolt movably received in the housing; a weapon barrel replaceably received in the housing and having a recess; and a locking member movably supported in the housing to assume locking and releasing positions. In the locking position the locking member projects into the recess for locking the weapon barrel to the housing and in the releasing position the locking member is withdrawn from the recess. There are further provided a spring for urging the locking member into the releasing position; a shaft rotatably supported in the housing and a cam secured to the shaft for rotating therewith as a unit and for contacting the locking member. The cam has a first angular position in which it holds the locking member in the locking position and a second angular position in which the spring holds the locking member in the releasing position. An external weapon-operating device moves the bolt into a first bolt position in which an accidental firing of a cartridge in the weapon barrel is possible and a second bolt position in which an accidental firing of a cartridge in the weapon barrel is not possible. The weapon-operating device moves the cam from the first into the second angular position when moving the bolt into the second bolt position.

The invention is essentially based on the principle to provide a barrel lock which is positively controlled as a function of the bolt position. The movement of the locking part and thus also its engagement into the recess provided in the weapon barrel is coupled with the motion of the bolt. As soon as the bolt assumes a position in which firing of a cartridge situated in the weapon chamber is safely prevented, the locking part is automatically withdrawn from the recess of the weapon barrel. Such an accidental firing may be caused, for example, by an unintentional forward motion of the firing pin relative to the bolt. It is apparent that such an accidental firing can take place only when the bolt is in its closed position (referred to earlier as a "first bolt position") and cannot take place when the bolt is open (referred to earlier as a "second bolt position"), that is, withdrawn from the cartridge chamber.

Such a positively controlled barrel lock has been found to be of particular advantage in an externally operated automatic weapon because in such a case the external weapon-operating device may simultaneously control the motion sequences of the bolt and the locking member (locking pin).

The control of the motion sequence of the locking device is effected preferably with the aid of a cam control in which a control cam, mounted on a rotatably supported shaft, presses against the spring-biased locking member and the shaft may be connected by means of a gearing with the external weapon-operating device that controls the motion sequence of the weapon bolt.

According to an advantageous feature of the invention, the locking member is a locking pin and, in its locking position, extends into a bore hole provided in the weapon barrel.

DESCRIPTION OF THE PREFERRED EMBODIMENT

Figure 1:
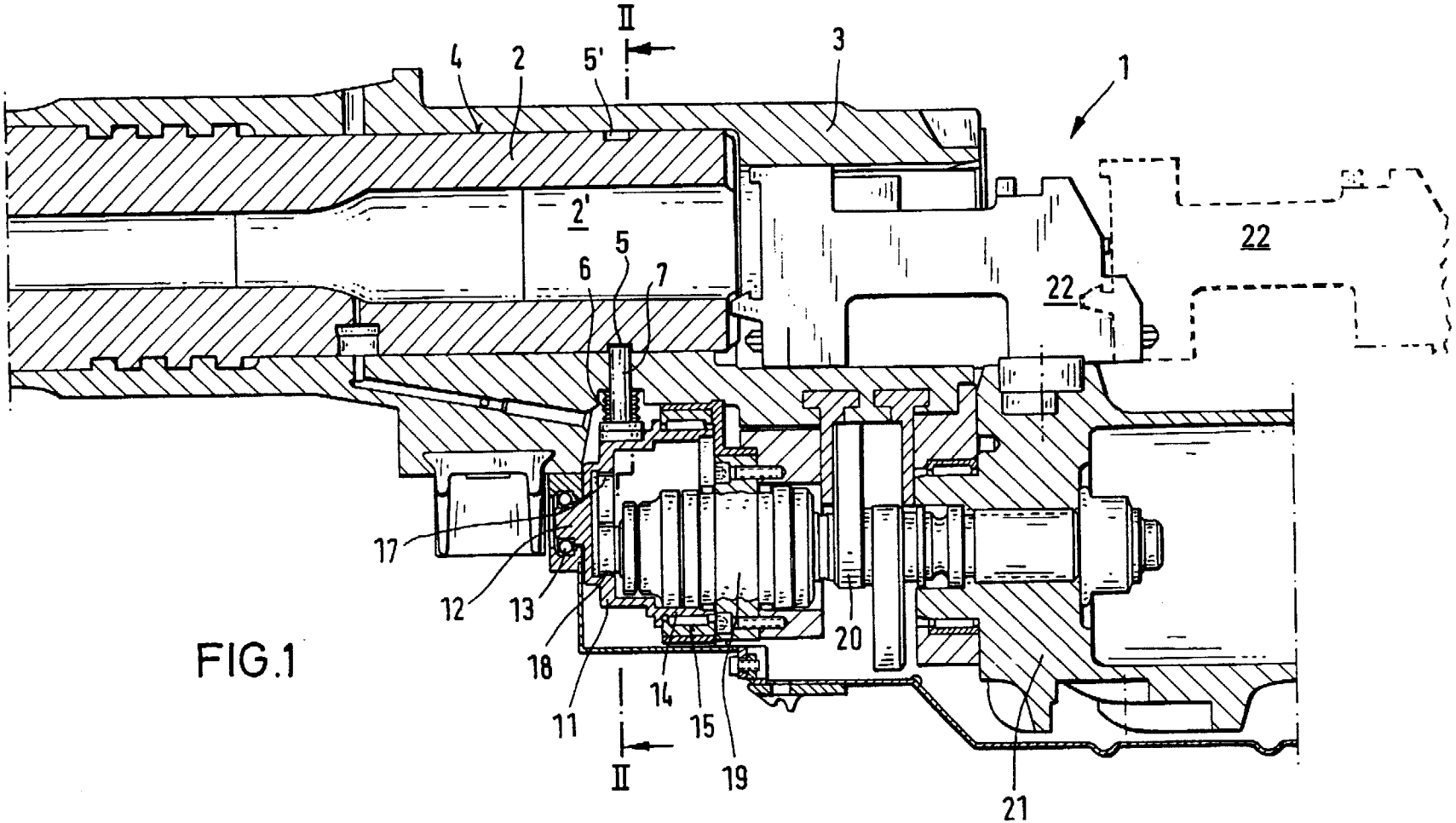
FIG. 1 is a sectional side elevational view of a weapon incorporating a preferred embodiment of the invention.

FIG. 1 illustrates an externally-operated automatic weapon 1. The weapon includes a weapon barrel 2 which has a cartridge chamber 2' and is supported in a weapon housing 1. In the outer surface 4 of the weapon barrel 2 a recess 5 is provided which may be a bore hole. An additional bore hole (or bore holes) 5' may be provided in the outer surface 4 of the weapon barrel 2. For locking the weapon barrel 2 to the weapon housing 3, a locking pin 7 may be advanced into the recess 5. The locking pin is shiftably supported in the weapon housing 3 and is biased by spring washers 6 in a direction away from the recess 5. The locking pin 7 has a follower head 8 which may be pressed by a control cam 9 or a cam control device 10 into the recess 5 of the weapon barrel 2 against the force of the spring washers 6 as illustrated in FIG. 2.

The cam control device 10 essentially comprises a hollow shaft 11 on which the control cam 9 is mounted and which, at one end, has a bearing stud shaft 12 supported in the weapon housing 3 by a roller bearing 13. At its other axial end the hollow shaft 11 is supported by a roller bearing 15 on a housing surface 14.

Figure 2:
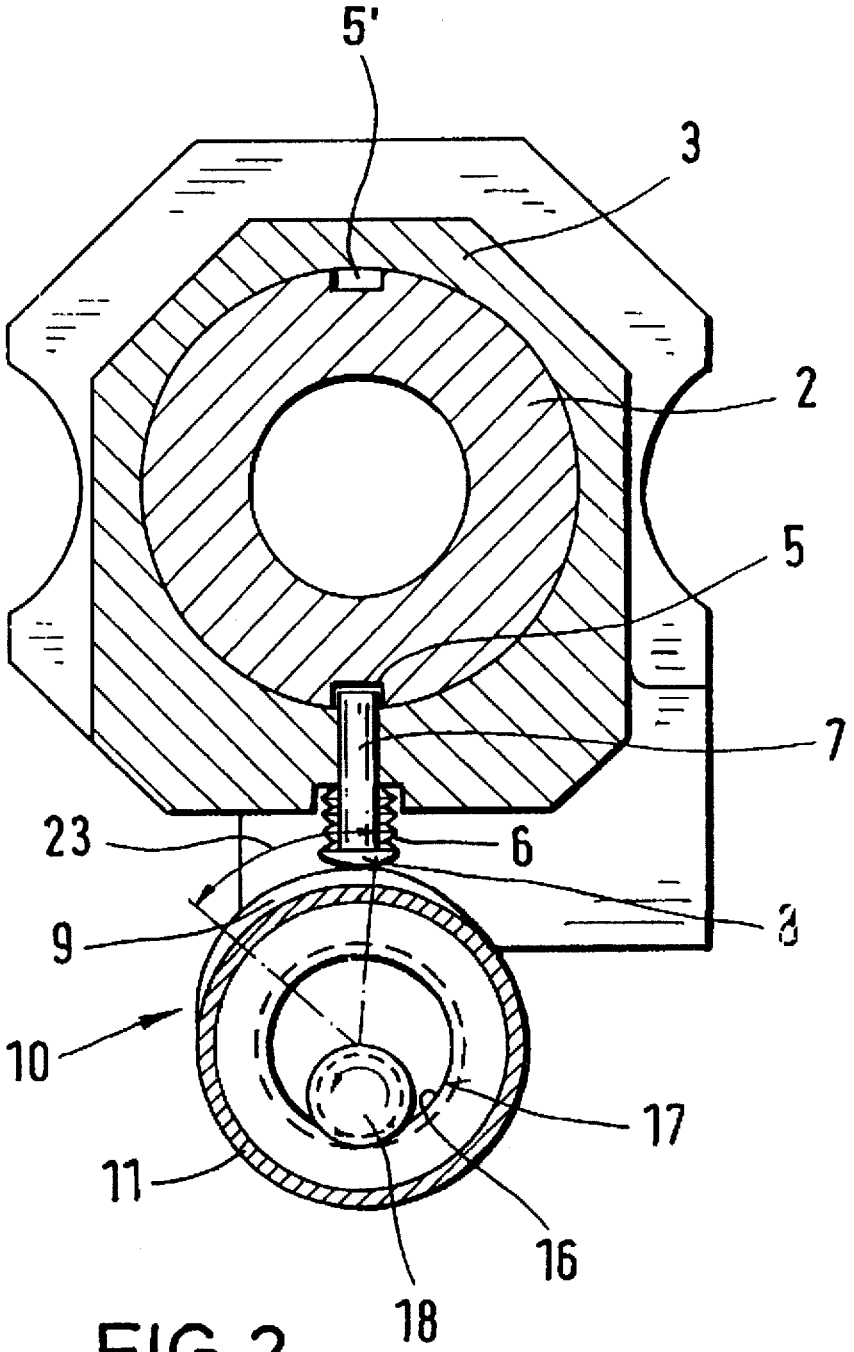
FIG. 2 is a sectional view taken along line II—II of FIG. 1, illustrating the weapon barrel in a locked state.

Also referring to FIG. 2, the inner surface 10 or the hollow shaft 11 has an inner ring gear 17 which meshes with a pinion 18 of a drive shaft 19 which, in turn, is connected by means of a gearing 20 with a drive roll 21 forming part of a conventional external weapon-operating device which is not shown in further detail for the sake of clarity.

Simultaneously with rotating the drive shaft 19, the weapon-operating device also controls—likewise in a conventional manner—the motion sequence of the bolt 22.

Figure 3:
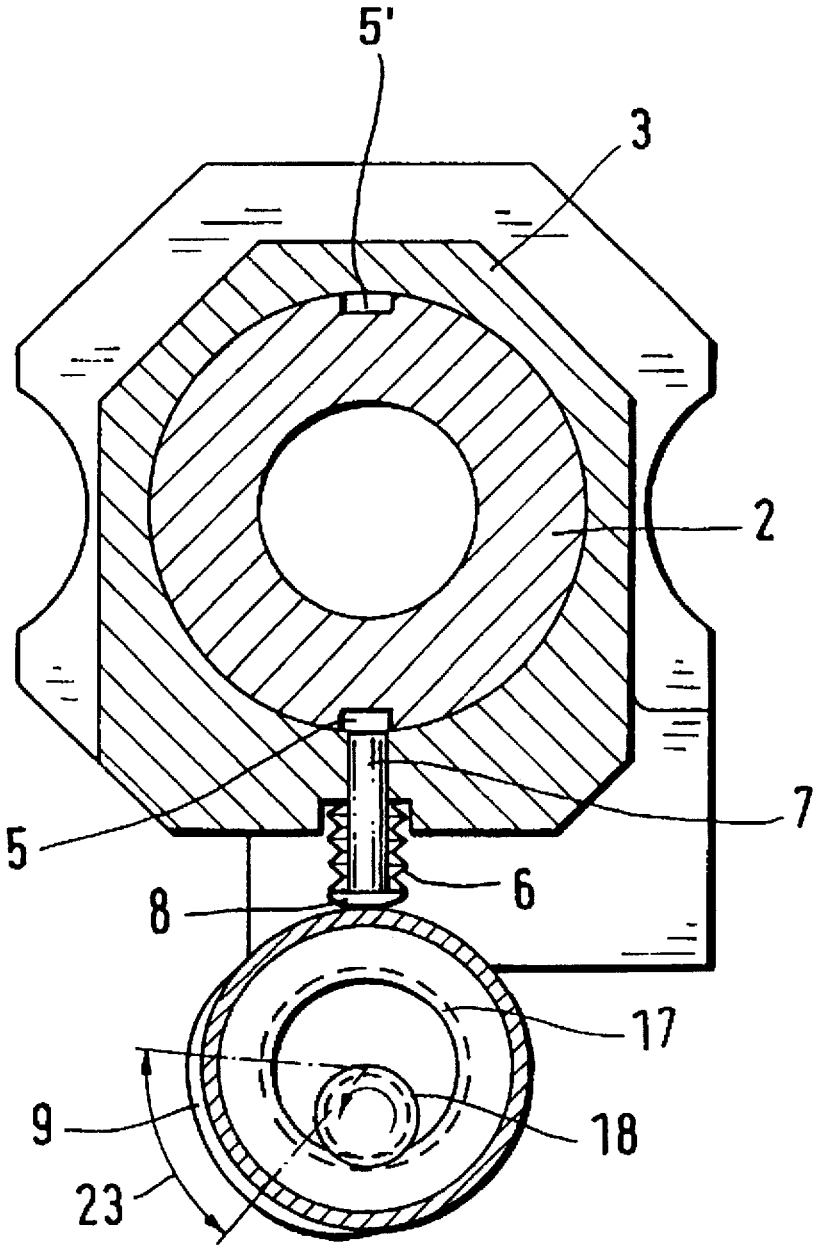
FIG. 3 is a view similar to FIG. 2, illustrating the weapon barrel in a released state.

While FIGS. 1 and 2 show the cam control device 10 in its state in which the locking pin 7 is pressed by the control cam 9 into the recess 5 of the weapon barrel 2 and thus the weapon barrel 2 is positively locked to the weapon housing 3, FIG. 3 illustrates the state in which, after rotating the hollow shaft 11 through a predetermined angle, the control cam 9 has been rotated away from the locking pin 7 which, as a result, is withdrawn by the washer springs 6 from the recess 5 of the weapon barrel 2. The position of the cam 9 and thus the withdrawn (releasing) position of the locking pin 7 is assumed only at a time when the bolt 22 has been moved by the external weapon-operating device into an open position in which no accidental firing of a cartridge may take place. In such a position which is shown in broken lines, the bolt 22 is, unlike in its position shown in FIG. 1, at a substantial distance from the cartridge chamber 2', so that any accidental forward motion of a firing pin contained in the bolt cannot impact on a cartridge which may be present in the cartridge chamber 2'.

The angle 23 illustrated in FIGS. 2 and 3 designates the path and, in case the rps of the hollow shaft 11 is given, the angle 23 also designates the time during which the locking pin 7 is pressed into the recess 5 by the control cam 9. The angle 23 may be selected such that the locking time for the barrel corresponds to the locking time of the bolt 22.

It will be understood that the above description of the present invention is susceptible to various modifications, changes and adaptations, and the same are intended to be comprehended within the meaning and range of equivalents of the appended claims.

What is claimed is:

1. An automatic weapon comprising (a) a housing;

(b) a bolt movably received in said housing;

(c) a weapon barrel replaceably received in said housing; said weapon barrel having a recess provided in an outer surface thereof;

(d) a locking member movably supported in said housing to assume a locking and a releasing position; in said locking position said locking member projecting into said recess for locking said weapon barrel to said housing and in said releasing position said locking member is withdrawn from said recess;

(e) spring means for urging said locking member into said releasing position;

(f) a shaft rotatably supported in said housing;

(g) a cam secured to said shaft for rotating therewith as a unit; said cam being in contact with said locking member; said cam having a first angular position in which said cam holds said locking member in said locking position and a second angular position in which said spring means holds said locking member in said releasing position; and (h) an external weapon-operating means for moving said bolt into a first bolt position in which an accidental firing of a cartridge in the weapon barrel is possible and a second bolt position in which an accidental firing of a cartridge in the weapon barrel is not possible; said external weapon operating means including means for placing said shaft and said cam into said first angular position when moving said bolt into said first bolt position and for placing said shaft and said cam into said second angular position when moving said bolt into said second bolt position.

2. The automatic weapon as defined in claim 1, wherein said shaft is hollow and has an inner ring gear; further comprising a pinion meshing with said ring gear and a drive roll rotating said pinion; said drive roll forming part of said external weapon-operating means.

3. The automatic weapon as defined in claim 1, wherein said locking member comprises a locking pin.

4. The automatic weapon as defined in claim 1, wherein said recess comprises a bore hole provided in said outer surface of said weapon barrel.

* * * * *